United States Patent [19]

Catalano et al.

[11] Patent Number: 4,893,441

[45] Date of Patent: Jan. 16, 1990

[54] LOAD-BEARING STRUCTURE FOR RAISED FLOORS

[75] Inventors: Cosimo Catalano, Padova; Paolo Pasto', Piove Di Sacco, both of Italy

[73] Assignee: Iceco S.P.A., Piove Di Sacco PD, Italy

[21] Appl. No.: 19,083

[22] Filed: Feb. 25, 1987

[30] Foreign Application Priority Data

Jun. 5, 1985 [IT] Italy ..... 41562 A/85

[51] Int. Cl.[4] ..... E04F 15/02

[52] U.S. Cl. ..... 52/126.6; 403/174

[58] Field of Search ..... 52/126.5, 126.6; 403/174, 175; 5/11; 248/188.3, 188.4

[56] References Cited

U.S. PATENT DOCUMENTS

| | | | |
|---|---|---|---|
| 1,833,174 | 11/1931 | Norris | 52/732 |
| 2,889,560 | 6/1959 | Carman | 5/11 |
| 3,616,584 | 11/1971 | Sartori | 52/126.6 |
| 3,811,237 | 5/1974 | Bettinger | 52/126.6 |
| 4,055,929 | 11/1977 | Stancati | 411/437 |
| 4,438,610 | 3/1984 | Fifer | 52/126.6 |

FOREIGN PATENT DOCUMENTS

| | | | |
|---|---|---|---|
| 291683 | 11/1967 | Australia | 52/126.6 |
| 2058167 | 6/1972 | Fed. Rep. of Germany | 52/126.5 |
| 3330612 | 6/1984 | Fed. Rep. of Germany | 52/126.6 |
| 1335886 | 7/1963 | France | 52/126.6 |
| 527875 | 6/1955 | Italy | 403/264 |
| 894142 | 1/1982 | U.S.S.R. | 52/126.6 |

*Primary Examiner*—Henry E. Raduazo

*Attorney, Agent, or Firm*—Guido Modiano; Albert Josif

[57] ABSTRACT

The structure is composed of a plurality of feet, each consisting of a section of square tubing which has at the base height adjustment means connected to a ground rest plate. Each foot bears on its top four crosspieces obtained by pressing from a sheet metal; the head of the crosspieces is shaped to cover an area of one fourth of the section of the foot tubing. The head edges are turned over to form hooking means for connection to the foot, while screw means are provided for achieving engagement among the crosspieces converging on a same foot and the foot itself. Each cross-piece is again covered by a U-like moulding of plastics which forms the rest plane for modular panels.

10 Claims, 3 Drawing Sheets

LOAD-BEARING STRUCTURE FOR RAISED FLOORS

BACKGROUND OF THE INVENTION

This invention relates to a load-bearing structure for raised floors.

Raised floors are usually obtained by arranging modular panels over a plurality of feet supporting them at the corners, said feet being preferably connected to a plurality of crosspieces, forming a grid.

Usually the upper portion of the foot is configured to support and center the panels which converge over it and is made either by casting or pressing from sheet metal.

In either case making is considerably expensive.

The crosspieces which form the grid must then provide means of hooking on the foot which must be particularly practical for installation.

SUMMARY OF THE INVENTION

It is the aim of this invention to provide a load-bearing structure for raised floors which is free of the drawbacks affecting presently utilised structures.

In particular an object of the invention is to provide a structure composed of few basic parts which should be simple and inexpensive.

Another object is to provide a structure which is easily assembled without requiring particular equipment.

The above aim and objects are achieved by a load-bearing structure for raised floors as defined in the appended claim 1.

BRIEF DESCRIPTION OF THE DRAWINGS

The features and advantages of the invention will be more apparent from the detailed description of a preferred embodiment given by way of illustration and not of limitation and shown in the accompanying drawings, where.

DESCRIPTION OF THE PREFERRED EMBODIMENTS

Figure 2:
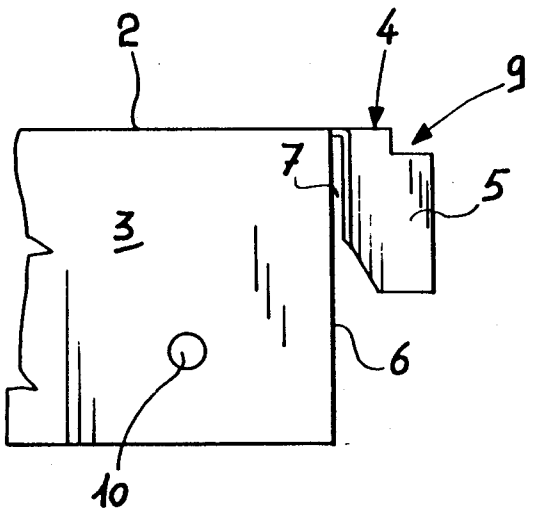
FIG. 2 shows a side view of a head of that same crosspiece.
Figure 1:
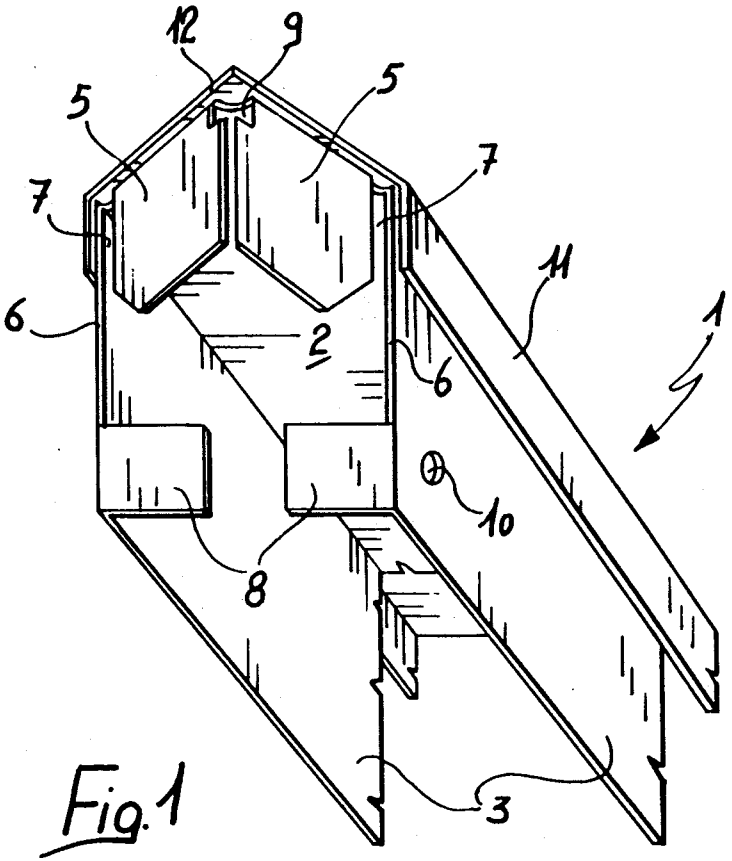
FIG. 1 shows a perspective broken view of a crosspiece which comprises the structure for pointing out the form of crosspiece heads.

With reference to the drawings, FIG. 1 shows a crosspiece generally indicated at 1 and obtained by bending a sheet metal into a "U" so as to obtain a flat upper face 2 or upper longitudinal wall which is continued by two vertical sides or bent side walls indicated at 3.

At each of the two crosspiece heads, of which one only is shown in FIG. 1 as the crosspiece 1 has been only partially illustrated, the upper face 2 is extended, with respect to the vertical sides 3, to form a triangular zone 4 defining two converging sides connected to two bent over, arrow-like arranged lugs or protruding walls 5 extending from the converging sides of the triangular zone 4 substantially parallel thereto and perpedicular to the upper face 2, the lugs 5 being spaced apart with respect to the forward edges 6 of the vertical sides 3 by a space or slot 7 of equal amplitude to the thickness of the sheet which forms the square tubing of the foot which will be illustrated herein below.

Said vertical sides 3 also have forwardly and in the lowermost part of the head two wings 8 bent over inwards of 90° to be coplanar with said forward edges 6 of the vertical sides 3.

The upper front corner of the bent over lugs 5 and the tip of the triangular zone 4 are relieved to create a recessed seat indicated at 9.

On each of said vertical sides 3, in the proximity of the forward edges 6 there is provided a through hole 10.

Every crosspiece 1 carries a V-shaped moulding 11 of plastics conformed inwardly to encircle the whole flat upper face 2 and partway the vertical sides 3 and cut forwardly to present a triangular zone 12 covering said zone 4 of the crosspiece 1 and with conformation equal to a fourth of a square.

Figure 3:
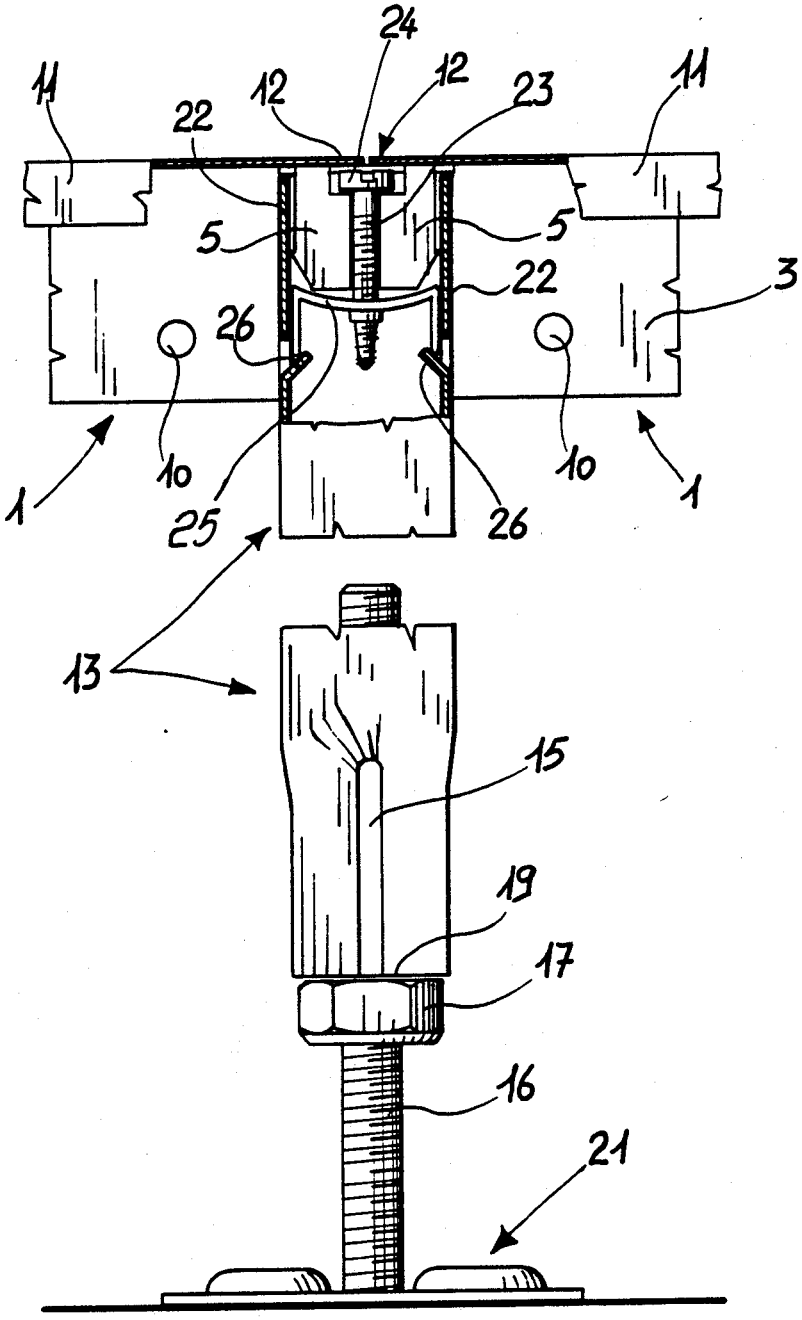
FIG. 3 shows a part-sectional side view of the foot and two crosspieces mounted to the top of the foot itself.
Figure 4:
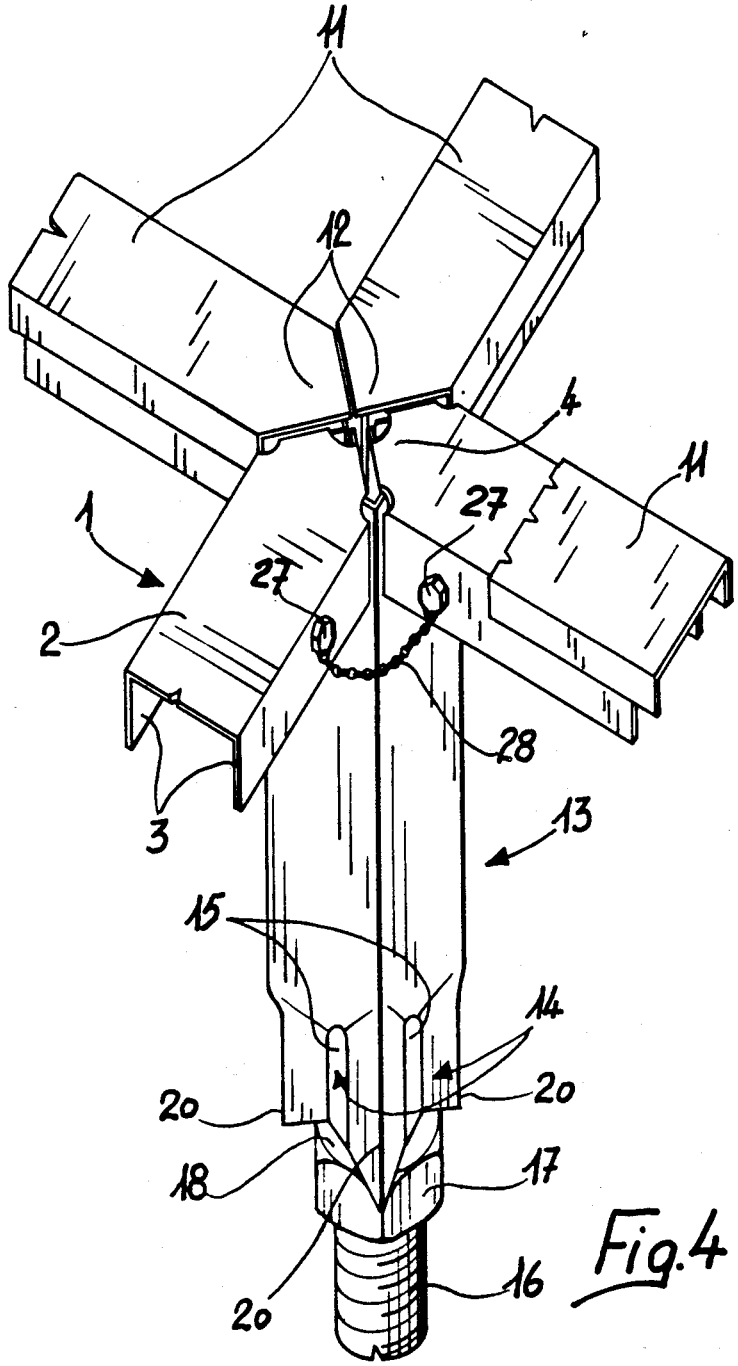
FIG. 4 shows a perspective view from above of the foot and the crosspieces connected thereto.

The foot 13 which completes the structure is made of a section of square metal tubing comprising walls 22 having a width equal to the width of the crosspiece 1 (FIGS. 3 and 4).

As visible in FIG. 3, each rest foot 13 has an upper open end for accomodating therein the lugs 5 of the crosspieces 1 and a lower end connected to a ground rest plate 21.

In the lower zone the foot 13 has four pinchings 14 made substantially at the center of each wall 22 of the square tubing, said pinchings determining four vertical ribs 15 protruding toward the tubing interior and forming, inside the tubing, a guide and centering seat for a threaded shank 16 whereon a height adjusting nut 17 is threaded, which, with its top face 18, bears the lower edges 19 of the walls 22 of the square tubing. Due to the presence of the pinchings 14, the foot square tubing forms four ribs 20 at the lower corners thereof.

At the lower end of said threaded shank 16 there is associated, for example by welding, the ribbed rest plate 21 which forms the foot base and extends substantially perpendicular to the rest foot 13.

Upwardly after hooking each moulding 1 to a respective wall 22 by slipping the upper edge of each wall in the spaces 7 of the respective moulding 1, a lockscrew 23 may be inserted from above in the recesses formed by the tips of the triangular zones 4. Then the lockscrew 23 is threaded over an inverted-U elastic element 25 inserted preliminarly into the upper portion of the square tubing, until the lockscrew head 24 rests in the recessed seats 9 previously described.

To prevent said elastic element 25 from sinking too far into the tubing when the screw is theaded in, the walls 22 present at least two turned in wings 26 opposite to each other and obtained by shearing or dimpling the walls 22, said wings 26 forming rest means for the element 25.

Preferably the elastic element 25 is arcuate, thereby under the action of the screw 23 it expands interfering with the inner walls of the foot square tubing and thus improving the connection among the crosspieces and the foot.

The screw 23 on the one side makes rigid with each other the four crosspieces 1 converging all on a same foot 13 and on the other side lock the heads of the crosspieces also with respect to the upper portion of the foot square tubing.

To improve the electrical continuity of the structure, the holes 10 may accommodate small bolts 27 interconnected by metal bridges or chains 28.

From what has been described and illustrated, it may be seen that the resulting structure is particularly simple both from the constructional viewpoint of the various components and the assembling viewpoint.

The crosspiece is greatly simplified and hooking on the foot is accomplished without the latter being equipped with any particular plate device as is usual the case with previously known feet.

The four crosspieces converging on one foot practically determine total closure of its upper portion, which closure is completed and secured by the plastics mouldings which are then superimposed on the crosspieces themselves. This involves a perfect closure of the section of the square tubing and prevents any passage of air stream which could generate between the lower portion and the upper portion of the floor.

This aspect is particularly advantageous in that below raised floors obtained with equivalent structures to the one illustrated, room conditioning air is usually introduced which of course is to get out solely where special outlets are provided but should not leak through the joints of the individual panels.

The structure lends itself well also for arrangement against the walls of the room because three, or two in the case of a corner, crosspieces would be anyhow firmly and individually hooked on each foot which may be laid against the wall without having to break, saw or anyhow eliminate parts thereof.

Hooking of each crosspiece obtained with the turned over lugs 5 cooperating with the wings 8 present in each head, is particularly strong, so that it is possible to hook crosspiece sections, working cantilever-fashion, for the necessary completions of the floors along the walls.

The covering of each crosspiece obtained with the plastics mouldings, completely isolates the floor panels from the underlying metal structure with clear safety advantages particularly in connection with any current losses which may occur in the event of failures or damage to the cables running under the floor. The electric continuity which is accomplished in the structure by means of the center screw and the metal bridges, allows grounding of the entire structure by connecting at least one point thereof to a sink.

The crosspieces are formed simply by shearing and pressing from sheet metal and the foot is just as simply composed of a section of square tubing cooperating with a threaded shank with rest plate welded to one of its ends.

In the event that it becomes necessary to increase the strength of the structure, the crosspiece may be made with a closed profile e.g. rectangular crosssection tubing.

Height adjustment is simply accomplished by acting on the nut 17 threaded over the shank 16 and constituting rest for the lower face of the square tubing.

Therefore, as explained, a load-bearing structure for raised floors has been provided which is composed of very simple and functional parts, the assembling whereof is particularly easy since it requires no tools nor for positioning the feet nor for locking the crosspieces.

Of course, starting from the same inventive concept, others may be the practical constructional forms that the structure may take while retaining the same concepts of hooking, locking and adjusting the crosspieces and feet.

Of course and materials and dimensions may be any ones depending on necessity.

We claim:

1. A load-bearing structure for raised floors, comprising:

a plurality of rest feet arranged at a mutual distance, each of said rest feet including a tubing section and a ground rest plate, said tubing section having a first end connected to said rest plate, a second, open end opposite to said first end and height adjusting means, said rest plate extending substantially perpendicular to said tubing section, a plurality of crosspieces, extending between pairs of rest feet and forming a rest grid, each of said crosspieces including a U-like bent sheet element including an upper longitudinal wall and two bent side walls, said upper longitudinal wall having two opposite ends extending each beyond said side walls and having a triangular shape defining two converging sides, each said crosspiece further including hooking means comprising two protruding walls extending from said converging sides substantially parallel thereto and perpedicular to said bent sheet element, said protruding walls extending at a distance from said side walls and defining therewith a pair of slots, said protruding walls being accomodated within said open end of one of said rest feet, with said tubing section partially extending into said slots, connection means arranged within said tubing sections proximate to said second open end, said connection means having a first portion engaging with said protruding walls of said crosspieces and a second portion engaging with an inner portion of said tubing section for firmly securing said crosspieces to said rest feet, and a covering structure, overlying said sheet elements.

2. A load-bearing structure according to claim 1, wherein said tubing section has a square shape, said open end accomodates the protruding walls of four crosspieces which are arranged at 90° to each other and said converging sides are mutually arranged at 90°.

3. A load-bearing structure according to claim 1, wherein said protruding walls present mutually facing recessed portions, said recessed portions defining together an accomodation seat for an enlarged head portion of said connection means, with said second portion of said connection means being secured to a transverse engagement member arranged within and supported by said tubing section.

4. A load-bearing structure according to claim 3, wherein said tubing section has at least two inwardly protruding wings defining stop elements for said transverse engagement member, said transverse engagement member comprising an elastic U-like shaped plate element having a central hole, and said connection means comprises a screw threadingly engaging in said central hole.

5. A load-bearing structure according to claim 1, wherein said tubing section has a square shape with a lower squeezed portion defining a narrow guide seat for a threaded shank rigidly connected to said rest plate, said threaded shank cooperating with an adjustment nut bearing said tubing section, said threaded shank and said adjustment nut forming together said height adjusting means.

6. A load-bearing structure according to claim 5, wherein said squeezed portion comprises four rib portions inwardly protruding toward a inner center portion of said tubing section and four corner members outwardly protruding between adjacent rib portions and resting on said adjustment nut.

7. A load-bearing structure according to claim 1, wherein said crosspieces have a closed profile and comprise a quadrangular metal tubing.

8. A load-bearing structure according to claim 1, wherein said open end of said tubing section has a square shape defining four delimitation sides and said U-like bent sheet elements further comprise each a pair of wing portions connected to said side walls and extending substantially perpendicular thereto and to said upper longitudinal wall, said wing portions resting against said delimitation sides of said tubing section outside of said open end.

9. A load-bearing structure according to claim 1, wherein said sheet elements are metal elements and said covering structure comprises plastics U-like shaped moldings, conforming with the dimensions of said metal elements, said moldings having opposite ends with triangular shape, said opposite ends fitting to one another and being arranged together so to completely cover said open end of said tubing section.

10. A load-bearing structure according to claim 1, further comprising electrical connection means connecting said crosspieces for allowing grounding of said load-bearing structure and connection thereof to a sink.

* * * * *